US008142614B2

(12) United States Patent
Biagiotti

(10) Patent No.: US 8,142,614 B2
(45) **Date of Patent: *Mar. 27, 2012**

(54) METHODS AND DEVICES FOR THE PRODUCTION OF TISSUE PAPER, AND WEB OF TISSUE PAPER OBTAINED USING SAID METHODS AND DEVICES

(75) Inventor: Guglielmo Biagiotti, Lucca (IT)

(73) Assignee: A. Celli Paper S.p.A., Capannori, Lucca (IT)

( * ) Notice: Subject to any disclaimer, the term of this patent is extended or adjusted under 35 U.S.C. 154(b) by 676 days.

This patent is subject to a terminal disclaimer.

(21) Appl. No.: 12/090,695

(22) PCT Filed: Oct. 17, 2006

(86) PCT No.: PCT/IT2006/000742

§ 371 (c)(1),
(2), (4) Date: Aug. 15, 2008

(87) PCT Pub. No.: WO2007/046124

PCT Pub. Date: Apr. 26, 2007

(65) Prior Publication Data

US 2009/0199986 A1 Aug. 13, 2009

(30) Foreign Application Priority Data

Oct. 20, 2005 (IT) ..... FI2005A0218

(51) Int. Cl.
*B31F 1/07* (2006.01)

(52) U.S. Cl. ..... 162/117; 162/109; 162/111; 162/205; 156/219; 264/282; 264/284

(58) Field of Classification Search ..... 162/109, 162/111, 117, 202, 204–205, 361, 369; 156/209, 156/219, 183; 264/282–284
See application file for complete search history.

(56) References Cited

U.S. PATENT DOCUMENTS

| | | | | |
|---|---|---|---|---|
| 4,072,557 | A | | 2/1978 | Schiel |
| 4,127,637 | A | * | 11/1978 | Pietreniak et al. ..... 264/119 |
| 4,356,059 | A | | 10/1982 | Hostetler |
| 4,440,597 | A | | 4/1984 | Wells et al. |
| 4,551,199 | A | | 11/1985 | Weldon |
| 4,849,054 | A | | 7/1989 | Klowak |

(Continued)

FOREIGN PATENT DOCUMENTS

EP 0 342 646 11/1989

(Continued)

OTHER PUBLICATIONS

JPO Machine Translation of JP 08-260037 dated Oct. 8, 1996.*

(Continued)

*Primary Examiner* — Jose A Fortuna
(74) *Attorney, Agent, or Firm* — McGlew and Tuttle, P.C.

(57) ABSTRACT

The invention relates to a method for the production of a web of tissue paper, comprising the steps of: depositing a layer of an aqueous suspension of papermaking fibers on at least one forming fabric; reducing the water content of said layer until the amount in weight of the fibers in said layer is brought up to a first value; wet-embossing said layer in a nip between a pair of embossing rollers; and drying said embossed layer using a drying system to form a web of tissue paper.

57 Claims, 9 Drawing Sheets

U.S. PATENT DOCUMENTS

| | | | | |
|---|---|---|---|---|
| 5,048,589 | A | 9/1991 | Cook et al. | |
| 5,126,015 | A * | 6/1992 | Pounder | 162/206 |
| 5,223,092 | A * | 6/1993 | Grinnell et al. | 162/109 |
| 5,314,584 | A * | 5/1994 | Grinnell et al. | 162/109 |
| 5,356,364 | A | 10/1994 | Veith et al. | |
| 5,562,805 | A | 10/1996 | Kamps et al. | |
| 5,607,551 | A | 3/1997 | Farrington, Jr. et al. | |
| 5,656,132 | A | 8/1997 | Farrington, Jr. et al. | |
| 5,667,636 | A | 9/1997 | Engel et al. | |
| 5,672,248 | A | 9/1997 | Wendt et al. | |
| 5,690,788 | A | 11/1997 | Marinack et al. | |
| 5,702,571 | A | 12/1997 | Kamps et al. | |
| 5,746,887 | A | 5/1998 | Wendt et al. | |
| 5,772,845 | A | 6/1998 | Farrington, Jr. et al. | |
| 5,888,347 | A | 3/1999 | Engel et al. | |
| 5,900,114 | A * | 5/1999 | Brown et al. | 162/117 |
| 5,904,812 | A * | 5/1999 | Salman et al. | 162/117 |
| 5,932,068 | A | 8/1999 | Farrington, Jr. et al. | |
| 6,077,390 | A * | 6/2000 | Salman et al. | 162/117 |
| 6,077,590 | A | 6/2000 | Archer et al. | |
| 6,171,442 | B1 | 1/2001 | Farrington, Jr. et al. | |
| 6,187,137 | B1 | 2/2001 | Druecke et al. | |
| 6,348,131 | B1 | 2/2002 | Kershaw et al. | |
| 6,398,909 | B1 * | 6/2002 | Klerelid | 162/109 |
| 6,416,623 | B1 * | 7/2002 | Hollmark et al. | 162/109 |
| 6,455,129 | B1 | 9/2002 | Kershaw et al. | |
| 6,488,816 | B1 | 12/2002 | Klerelid | |
| 6,503,370 | B2 * | 1/2003 | Hollmark et al. | 162/117 |
| 6,524,683 | B1 | 2/2003 | Roussel et al. | |
| 6,585,861 | B2 * | 7/2003 | Odhe et al. | 162/280 |
| 6,596,127 | B2 * | 7/2003 | Hollmark et al. | 162/206 |
| 6,681,826 | B1 * | 1/2004 | Biagiotti | 156/470 |
| 6,755,928 | B1 * | 6/2004 | Biagiotti | 156/209 |
| 6,811,652 | B2 * | 11/2004 | Hollmark | 162/109 |
| 7,285,317 | B2 * | 10/2007 | Biagiotti et al. | 428/166 |
| 7,291,379 | B2 * | 11/2007 | Biagiotti | 428/166 |
| 7,758,724 | B2 * | 7/2010 | Akai et al. | 162/117 |
| 7,799,167 | B2 * | 9/2010 | Suzuki et al. | 162/117 |
| 2001/0013389 | A1 * | 8/2001 | Fingal et al. | 156/160 |
| 2002/0060007 | A1 * | 5/2002 | Hollmark et al. | 162/132 |
| 2002/0060008 | A1 | 5/2002 | Hollmark et al. | |
| 2002/0092633 | A1 * | 7/2002 | Odhe et al. | 162/111 |
| 2002/0116519 | A1 | 8/2002 | Wang | |
| 2003/0013318 | A1 | 1/2003 | Shiraishi et al. | |
| 2003/0021953 | A1 | 1/2003 | Graff | |
| 2003/0026953 | A1 * | 2/2003 | Muller | 428/174 |
| 2003/0041989 | A1 * | 3/2003 | Oriarian et al. | 162/184 |
| 2003/0116292 | A1 | 6/2003 | Hollmark | |
| 2004/0003905 | A1 * | 1/2004 | Hilbig et al. | 162/117 |
| 2004/0038006 | A1 * | 2/2004 | Biagiotti | 428/172 |
| 2004/0055721 | A1 * | 3/2004 | Hilbig et al. | 162/117 |
| 2004/0168780 | A1 * | 9/2004 | Dwiggins et al. | 162/125 |
| 2004/0247836 | A1 * | 12/2004 | Biagiotti | 428/172 |
| 2005/0147797 | A1 * | 7/2005 | Biagiotti et al. | 428/172 |
| 2005/0170145 | A1 * | 8/2005 | Biagiotti et al. | 428/156 |
| 2005/0230069 | A1 * | 10/2005 | Hilbig et al. | 162/117 |
| 2005/0257894 | A1 * | 11/2005 | Biagiotti | 156/553 |
| 2006/0037724 | A1 * | 2/2006 | Akai et al. | 162/117 |
| 2006/0042767 | A1 * | 3/2006 | Bhat et al. | 162/117 |
| 2006/0081347 | A1 * | 4/2006 | Kershaw et al. | 162/117 |
| 2006/0278357 | A1 * | 12/2006 | Suzuki et al. | 162/117 |
| 2006/0280910 | A1 * | 12/2006 | Boatman et al. | 428/156 |
| 2008/0169072 | A1 * | 7/2008 | Pare et al. | 162/117 |
| 2008/0302493 | A1 * | 12/2008 | Boatman et al. | 162/109 |
| 2008/0308240 | A1 * | 12/2008 | Biagiotti | 162/117 |
| 2009/0126885 | A1 * | 5/2009 | Akai et al. | 162/117 |
| 2009/0199986 | A1 * | 8/2009 | Biagiotti | 162/117 |
| 2010/0038045 | A1 * | 2/2010 | Pare et al. | 162/117 |

FOREIGN PATENT DOCUMENTS

| | | | |
|---|---|---|---|
| EP | 0 625 610 | A1 | 11/1994 |
| EP | 739708 | A2 * | 10/1996 |
| EP | 1731296 | A2 * | 12/2006 |
| JP | 06-206269 | | 7/1994 |
| JP | 07-258999 | | 10/1995 |
| JP | 08260397 | A * | 10/1996 |
| JP | 11-081177 | | 3/1999 |
| JP | 2000073299 | A * | 3/2000 |
| JP | 2002-522323 | | 7/2002 |
| JP | 2002-526685 | | 8/2002 |
| JP | 2002-526688 | | 8/2002 |
| JP | 2002-526689 | | 8/2002 |
| JP | 2002-526690 | | 8/2002 |
| WO | WO 99/23300 | | 5/1999 |
| WO | WO 9944814 | A1 * | 9/1999 |
| WO | 00/20680 | | 4/2000 |
| WO | 00/20684 | | 4/2000 |
| WO | 00/20685 | | 4/2000 |
| WO | WO 0020683 | | 4/2000 |
| WO | WO 2005106116 | | 11/2005 |
| WO | WO 2007046124 | A1 * | 4/2007 |

OTHER PUBLICATIONS

Machine Translation of JP 2000-073299 A, filed on Mar. 2000.*
Machine Translation of JP 08-260397 filed on Oct. 1996.*

* cited by examiner

METHODS AND DEVICES FOR THE PRODUCTION OF TISSUE PAPER, AND WEB OF TISSUE PAPER OBTAINED USING SAID METHODS AND DEVICES

TECHNICAL FIELD

The present invention relates in general to the production of so-called tissue paper, in some cases also referred to as "crepe paper", for the formation of rolls of toilet paper, paper wipes, and paper for similar uses. More in general, the invention relates to the production of a web-like fiber material, especially papermaking fibers or cellulose fibers, with a high capacity of absorption and a high degree of softness.

STATE OF THE ART

A major sector of the paper industry is directed at the production of paper with good characteristics of liquid absorption and softness, for the production of products such as toilet paper, paper wipes, and the like. This type of paper product goes by the technical name of "tissue paper" and in certain cases "crepe paper", as a result of the fact that a crinkling or creping is imparted thereon in a step of formation, adopting various possible systems. The most widespread of these envisages the adhesion of the web of cellulose fibers, which still contains a large amount of water, on an internally heated roller or drum of large diameter, referred to as "Yankee drier" or "Yankee roller". Consequently, upon drying, the fiber web remains adherent to the roller and is detached therefrom using a doctor blade, which impresses a corrugation or crinkling on the paper during detachment thereof from the roller. This corrugation is responsible for an increase in the volume or bulk of the paper and its elasticity, which is prevalently in the working direction of the machine or machine direction, i.e., the direction parallel to the direction of feed of the web through the machine.

Examples of systems for wet production of tissue paper using the above system are described in the U.S. Pat. Nos. 4,356,059; 4,849,054; 5,690,788; 6,077,590; 6,348,131; 6,455,129; 5,048,589; 6,171,442; 5,932,068; 5,656,132; and 5,607,551, and in the European patent No. 0342646.

These systems, referred to technically as "continuous machines", all envisage, in addition to other elements or particular apparatuses, the presence of a headbox, which forms, on a forming fabric, a layer of a mixture of papermaking fibers and water, with a very low percentage of dry content, in the range of 0.5 wt % to 0.8 wt %. By means of successive steps, the percentage of water is progressively reduced until a web is formed with a dry content of fibers in the range of 48-52 wt %, according to the type of system, at the moment in which the web is transferred from a fabric or felt to the rotating surface of the Yankee roller with the aid of a press, and here the humidity of the web is further reduced, until a percentage of fiber of 95-98 wt % is obtained. The web is at this point considered dry and ready for the next step; consequently, it is detached by the creping blade and then wound on a reel, as mentioned above.

In some systems, such as for example the one described in the U.S. Pat. No. 4,356,059, there are provided two Yankee rollers arranged in series, set between which is a hot-air drying system referred to as "Through Air Drier" (TAD), in which the web of cellulose fibers is entrained around a rotating roller with a pervious cylindrical wall, through which a flow of hot air is generated. This drying system yields a web of large thickness and volume.

The use of the creping blade involves numerous drawbacks, in the first place, tearing of the web. The mechanical action of the blade on the web of fiber is, in fact, rather violent and constitutes the principal cause of tearing of the web during its detachment from the drying roller. Tearing of the web in systems for wet production of paper represents a serious problem in so far as, since it is not possible to stop the system, which is built for working continuously on three shifts a day on account of the thermal inertia especially of the Yankee roller, there will be interruptions in the web wound in reels which entail serious technical consequences and, above all, consequences of an economic nature in the form of a major loss in efficiency of the conversion systems that use these reels.

Other drawbacks of the technique of creping using a blade which co-operates with the Yankee roller are represented by: the fast wear of the creping blade, Which must be replaced even twice in a single shift; the high degree of compactness of the fibers in the web that is consolidated and dried on the smooth surface of the Yankee roller; the formation of dense hydrogen bonds between the fibers, oriented prevalently according to horizontal planes; and the difference in thickness of the web obtained with a new blade and with a worn blade, which evidently does not guarantee constancy of characteristics of the web (see U.S. Pat. No. 6,187,137).

According to a different technique, a corrugation in the web is obtained by passing the web still having a high content of humidity from one forming fabric, which moves at a first speed of advance, to a second forming fabric, which moves at a second speed of advance, lower than the first speed of advance. The deceleration undergone by the web causes creping and corrugation thereof. A suction system set appropriately with respect to the forming fabrics withholds the paper material being formed to facilitate the generation of crinkles in the web. Examples of systems based upon this technology are described in the U.S. Pat. Nos. 4,072,557 and 4,440,597.

The U.S. Pat. No. 4,551,199 describes a method and a system in which the web is transferred from a faster fabric to a slower fabric and in which the slower fabric has a particular surface mesh to bring about corrugation of the web.

Similar systems and methods of this type are described in the U.S. Pat. Nos. 5,607,551; 5,656,132; 5,667,636; 5,672,248; 5,746,887; 5,772,845; 5,888,347; and 6,171,442.

In the systems known from these prior art documents, downstream of the fabric on which the corrugation takes place, the web is dried with a TAD system, thus preventing also the other drawbacks linked to the use of the Yankee roller.

On the other hand, the TAD systems are also affected by drawbacks which render their use as an alternative to the drying system with the Yankee drier not always practicable or desirable. For example, the costs in terms of energy consumption are higher, on account of the need to generate enormous rates of flow of hot air that traverses the web to dry it. In addition, the web thus formed is thicker than the one obtained with the creping blade and can present through holes, due to the use of the flow of air that traverses the web to dry it.

To increase the thickness of the paper material produced by continuous machines, there have been suggested various methods and techniques combined with one or the other of the different creping systems. In U.S. Pat. No. 6,077,590, for example, downstream of the Yankee roller with corresponding creping blade there is provided a moistening system or humidifier, in which the paper that has previously been dried and creped is once again moistened. At output from the humidifier, there is provided a wet-embossing assembly, comprising a pair of embossing rollers made of steel, one of which has protuberances and the other has mutually corresponding cavities. The purpose of this system is to obtain a product having a large thickness and a high degree of strength. The use of a Yankee roller and, downstream thereof, of a moistening section and a wet-embossing section involves numerous drawbacks. The main drawbacks are the following: the problems deriving from the risks of tearing of the web on account of the use of a creping blade are not solved; the production line is complex, costly and cumbersome; and the humidification of the web involves high consumption levels in terms of energy and water.

Described in U.S. Pat. No. 4,849,054 is a system in which the web of cellulose fibers with high water content is transferred along its path to a forming fabric that has a surface texture given by the mesh of the fabric that forms it, which imparts an embossing on the web. This is due to the fact that the web, with high water content and hence limited strength, comes to rest on the depressions formed between the threads defining the structure of the fabric. Embossing is facilitated by the use of a suction system set on the side of the fabric opposite to the side on which the web comes to rest. Also in this case, the web embossed using this technique is subsequently dried on a Yankee roller and creped with a creping blade that detaches it from the drying roller. The system is thus characterized by the drawbacks described above, which are linked to the use of creping blades.

The use of a fabric with a surface structure designed to bestow a wet-embossing effect on the web being formed is described also in U.S. Pat. No. 6,187,137 and in WO-A-9923300. Embossing is obtained by the combination of the particular fabric with the aforesaid surface structure by means of a pressurized-air system, which transfers the web from a fabric set-upstream to the surface-structured fabric. In order to avoid the use of a creping blade in combination with a Yankee roller and at the same time in order not to use a TAD drying system, with the corresponding costs associated thereto and mentioned above, it has been suggested in the above documents of the prior art to carry out an operation subsequent to embossing on fabric, consisting in making the web, whilst still damp, adhere to a Yankee roller, drying it, and subsequently detaching it therefrom without the use of a creping blade. In this way, drying involves lower costs as compared to drying using TAD systems, and the creping blade, which presents drawbacks deriving therefrom, is not used.

However, this technique involves application on the Yankee roller of a mixture of adhesive agents and of detaching agents in order to enable, on the one hand, proper adhesion of the web to the roller and, on the other, ease of detachment without any risk of tearing and without the use of mechanical members such as the creping blade. The use of this mixture of products, on the one hand, involves drawbacks in terms of consumption and of operating costs and, on the other, constitutes a critical aspect of the process, in so far as the products applied must in effect perform two mutually contrasting actions, with the consequent need to select carefully the products of the mixture and to balance them in a precise and accurate way.

Described in the documents No. US-2002/0060034, US-2002/0124978, and US-2003/0116292 are systems and methods for embossing a layer of tissue paper in conditions of high humidity content. These methods and devices envisage entraining the layer of cellulose fibers around a drying drum provided with protuberances, which impress an embossing pattern on the paper during drying. The paper is pressed against the drying drum provided with protuberances via a fabric or felt set behind which is a pressure roller, or else directly via a pressure roller made of compliant material.

OBJECTS AND SUMMARY OF THE INVENTION

A general object of the present invention is a method and a system for the production of tissue paper, which will overcome entirely or in part one or more of the aforesaid drawbacks typical of traditional systems and methods.

The object of an improved embodiment of the invention is a method and a system with which a tissue paper can be obtained with characteristics similar to or even better than those of the paper creped using a creping blade, but without the use of the creping blade and hence avoiding the drawbacks linked to the latter, in the first place the risk of tearing of the web during its detachment from the drying cylinder.

According to a particular aspect of a specific embodiment of the invention, a further object is to increase the productivity of the continuous machine, at the same time reducing the amount of energy required for drying the web produced and the amount of fibers required.

Basically, according to a first aspect, the invention relates to a method for the production of a web of tissue paper, comprising the steps of:

- depositing a layer of an aqueous suspension of papermaking fibers on a forming fabric;
- reducing the water content in said layer, preferably by applying pressure, i.e., squeezing of the layer, until the amount in weight of fibers in said layer is brought up to a first value;
- wet-embossing said layer in a nip between a pair of embossing rollers; and
- drying said layer by causing it to pass through a drying system to form a web of tissue paper.

The drying system can comprise a Yankee cylinder or the like. In the step of squeezing of the water out of the layer of cellulose fibers, for example via pressure in a nip between two rollers or in a number of nips between pairs of consecutive rollers, it is advantageously possible to obtain a first value of dry content of between 20 wt % and 90 wt % and preferably between 40 wt % and 80 wt %, and more preferably still between 50 wt % and 70 wt % of fibers with respect to the total weight of the layer. If necessary, before or during squeezing of the web in order to reduce the water content it is possible to apply suction to facilitate drainage of the water itself.

The elimination of a high amount of water via pressure, i.e., by squeezing of the layer of aqueous pulp of cellulose fibers enables a series of advantages to be achieved, amongst which the reduction in the amount of water to be eliminated via supply of heat, and generation of bonds between the fibers, which render the end product stronger, as will be described more clearly in what follows.

Essentially, the invention envisages creping the layer of papermaking fibers to bestow on the web the desired elasticity, in particular via an embossing process based upon a particular pattern or texture that has the capacity of creating a dense series of elastic profiles when the web being formed is still moist and of completing drying of said web in a subsequent step so as to create in the material a "memory", i.e., a tendency to return into its initial configuration if subjected to a tensile stress and then released, instead of creping the material that has reached complete drying using a blade or doctor knife that works in combination with a drying cylinder, such as, for example, a so-called Yankee drier, to detach the web when completely dry and create thereon the micro-crinkles that bestow elasticity on the web.

According to some of the known methods and systems, there is in effect carried out a wet-embossing of the layer of papermaking fibers. However, this embossing is not carried out using a pair of embossing cylinders or rollers, but rather by resting the moist layer of papermaking fibers on a fabric presenting a coarse surface structure, and only has the purpose of bestowing a thickness on the web. In the known systems that use this technique, the layer of papermaking fibers is in any case subjected to an operation of drying and of creping using a detaching blade co-operating with a Yankee cylinder. According to the invention, instead, the corrugation on the web of fibers is imparted substantially only as a result of an embossing between at least one pair of embossing cylinders or rollers and has two purposes: the first and most important purpose is to bestow elasticity on the paper without the use of a creping blade, and the second purpose is to impart a thickness on the web itself.

Drying after embossing can be achieved using a drying cylinder set downstream of the embossing rollers, or else using a set of return idlers, around which the layer of papermaking fibers is entrained. Alternatively, drying can be obtained entirely or partially by entraining the embossed web around a set of rollers inside an infrared or microwave oven or else via the use of embossing rollers, one of which is heated. All these systems can also be used in combination with a hot-air hood, which contributes to reducing the drying time, working also on the second face of the web. The above or other equivalent drying systems can be combined with one another.

The reduction in the water content of the layer of papermaking fibers prior to embossing thereon is carried out until a dry content is reached, i.e., a weight percentage of fibers with respect to the total weight of the layer, which bestows-on the layer itself a consistency sufficient to withstand the mechanical operation of embossing.

According to an advantageous embodiment of the invention, at least a first one of said embossing rollers is provided with protuberances, and at least a second one of said embossing rollers is provided with cavities, in which said protuberances of the first embossing roller penetrate. In practice, the two rollers have corresponding incisions, which define complementary protuberances and cavities, preferably in a number comprised between 20 and 120 per $cm^2$, so that the two rollers co-operate with one another with the protuberances of one which mesh with the protuberances of the other; i.e., they penetrate into the cavities of the other. Basically, in a particular configuration, the two rollers can be identical to one another.

In contrast with what is most frequently envisaged in the embossing process performed, during conversion, on the dry paper, which occurs between a rigid cylinder provided with protuberances and a pressure cylinder that is smooth and is coated with compliant material (normally rubber), in the wet-embossing process according to the invention the web or layer of papermaking fibers still moistened is passed between the protuberances of the first roller that mesh with the cavities formed by the protuberances of the second roller and vice versa, bestowing on the web or layer a deformation that generates thereon the desired elasticity and increases the total final thickness thereof.

Preferably, but not necessarily, the embossing rollers are kept at a distance such that the protuberances of the first embossing roller and the cavities of the second embossing roller are not in mutual contact, but rather preferably are kept at a distance apart equal to or slightly greater than the thickness of the layer of papermaking fibers.

Preferably, but not necessarily, the protuberances of the first embossing roller have a base with a first dimension in the direction of advance of the layer (referred to also as machine direction) smaller than a second dimension in the transverse direction or cross machine direction. For example, the protuberances can have a pyramidal shape with a quadrangular base, in particular, preferably, rhomboidal with more or less rounded edges, with the minor diagonal oriented according to the direction of advance of the layer and the major diagonal oriented according to a transverse direction.

According to a different aspect, the invention provides a method for the production of tissue paper, comprising the steps of:

- depositing a layer of an aqueous suspension of papermaking fibers on at least one forming fabric;
- reducing the water content in said layer, until the amount in weight of fibers in said layer is brought up to a first value;
- wet-embossing said layer in a nip between a pair of embossing rollers;
- drying said layer to form a web of tissue paper and in which, after embossing, said layer is calendered.

According to a different aspect, the invention relates to a system for the production of tissue paper, comprising: at least a headbox; at least a forming fabric, on which said headbox distributes a layer of an aqueous suspension of papermaking fibers; a system for removal of water from said layer to bring it to a first degree of dryness, said system comprising means for exerting a pressure, i.e., a squeezing, of the layer in order to extract at least part of the water contained therein; an embossing assembly comprising a first embossing roller and a second embossing roller, between which there passes the layer prior to total removal of water; and a drying system for drying the embossed layer of papermaking fibers.

According to a different aspect, the invention envisages a system for the production of tissue paper, comprising: at least a headbox; at least a forming fabric, on which said headbox distributes a layer of an aqueous suspension of papermaking fibers; a system for removal of water from said layer to bring it to a first degree of dryness; an embossing assembly comprising a first embossing roller and a second embossing roller, between which there passes said layer prior to total drying; a drying system for removing water from the embossed layer; and a calender set downstream of the embossing assembly and preferably downstream of the drying system.

Further advantageous features and embodiments of the invention are specified in the attached claims and will be described in greater detail with reference to a non-limiting example of embodiment.

BRIEF DESCRIPTION OF THE DRAWINGS

A better understanding of the invention will emerge from the description and the annexed drawings, which illustrate a practical non-limiting embodiment of the invention. In the drawings.

DETAILED DESCRIPTION OF A PREFERRED EMBODIMENT OF THE INVENTION

Figure 1A:
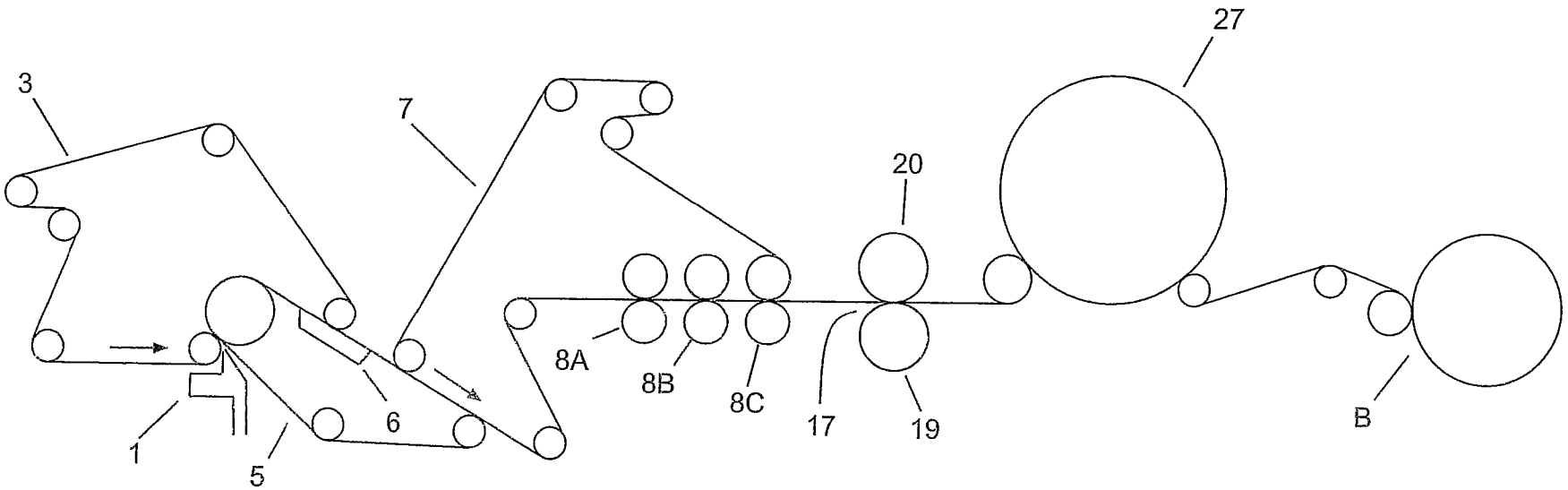
FIGS. 1A, 1B, and 1C are three schematic illustrations of a system according to the invention.

FIG. 1A is a schematic illustration of the arrangement of a possible system for production of tissue paper according to the invention. The reference number 1 designates as a whole a headbox that forms a layer of a suspension or a mixture of papermaking fibers and water (with possible further additives known to those skilled in the art) that is fed between two forming fabrics designated by 3 and 5. The direction of advance of the two forming fabrics 3 and 5 is indicated by the arrows in FIG. 1. In the example illustrated, associated to the forming fabric 5 is a suction system 6, which carries out drainage of part of the water contained in the mixture or suspension forming the layer S.

The layer S, which is formed between the fabrics 3 and 5 and from which part of the water has been drained via the suction system 6, is transferred to at least one conveying felt 7, which passes through at least one pair of pressure rollers, accompanying the layer of cellulose fibers. In the example illustrated three pairs of pressure rollers 8A, 8B, 8C are provided, even though this is not binding in so far as the reduction in the water content can be obtained also with other means, such as, for example, vacuum systems or the like. By passing in the nip of one or more pairs of rollers, the layer is squeezed and a considerable part of its own residual water content is eliminated by squeezing, i.e., by pressure. It is not excluded to pass between the pressure rollers a pair of felts or fabrics set alongside one another, set between which is the layer to be squeezed.

At output from the pressure rollers 8A, 8B, and 8C a layer is obtained with a dry content for example equal to or higher than 20 wt %, preferably between 20 wt % and 90 wt %, more preferably between 40 wt % and 80 wt %, and more preferably still between 50 wt % and 70 wt %, for example around 60 wt % of dry content with respect to the total weight of the wet layer.

This layer has a consistency that is sufficient for being fed to an embossing assembly 17 and there being subjected to a wet embossing.

The embossing assembly 17 comprises a first embossing roller 19 and a second embossing roller 21, which define between them an embossing nip, through which there is fed the layer S of papermaking fibers, which has been previously partially dried on the drying roller 9.

Figure 2:
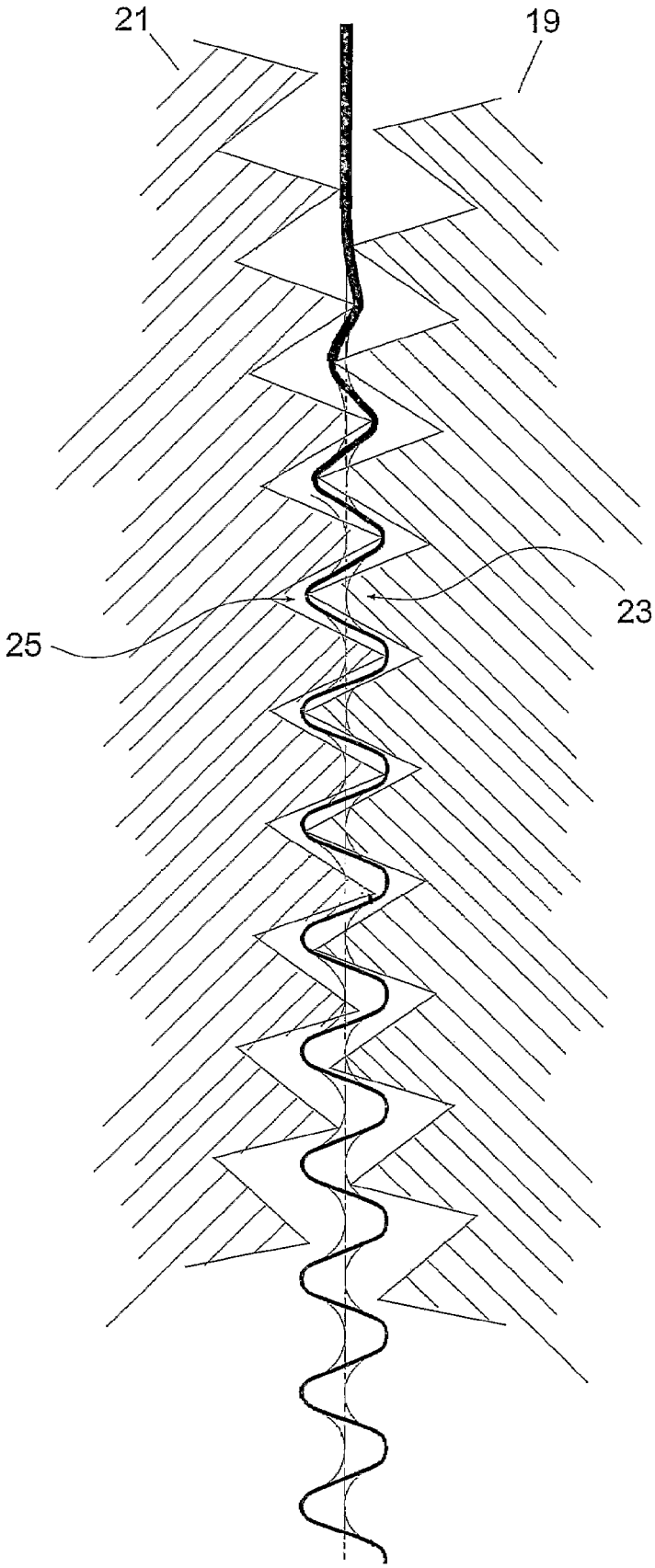
FIG. 2 shows an enlargement of the nip between the two embossing rollers in a section perpendicular to the axis of the rollers themselves.
Figure 3:
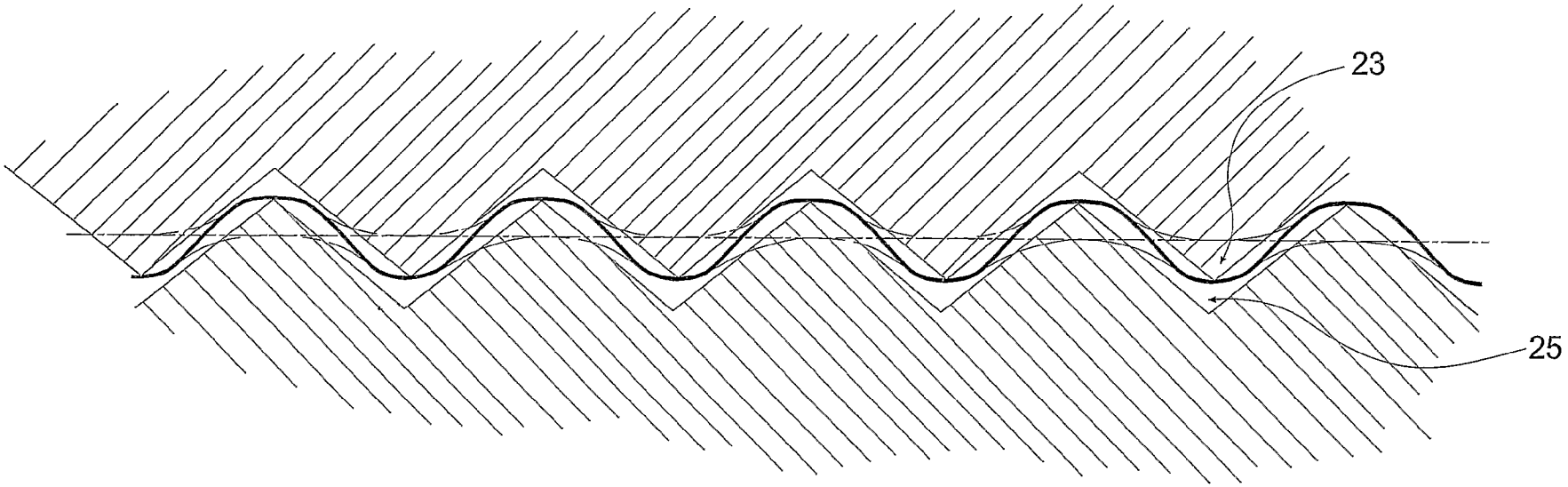
FIG. 3 is a cross-sectional view of the nip between the two embossing rollers according to a plane containing the axes of the rollers.

As illustrated in particular in FIGS. 2 and 3, the two embossing rollers 19, 21 are provided with protuberances 23 and cavities 25 corresponding to one another, i.e., which mesh with one another. Said protuberances and cavities can be obtained by etching using a machining system, by plastic deformation, chemical etching, or by any other known system. The surfaces of the two rollers can be complementary, with the protuberances of one corresponding to the cavities or incisions of the other. In a practical embodiment, it may be envisaged that the two cylinders will be both obtained using a process of etching that generates protuberances having the shape of a truncated pyramid or a pyramid. The cavities are represented by the empty spaces present within each set of four protuberances.

The distance between the centers of the embossing rollers 19, 21 is such that the two rollers do not touch one another even in the position corresponding to the plane of lie of the respective axes. Between the surface of the protuberances 23 and the surface of the corresponding cavities 25 there always remains, also in the nip between the rollers, a space substantially equal to the thickness of the layer S of papermaking fibers, or else slightly greater than said thickness. In this way, the layer S is not squeezed and is not stressed mechanically by compression as occurs, instead, in dry embossing of the paper when a cylinder provided with protuberances is pressed against a roller coated with smooth rubber, the surface of which is deformed by the embossing pressure.

Figure 4:
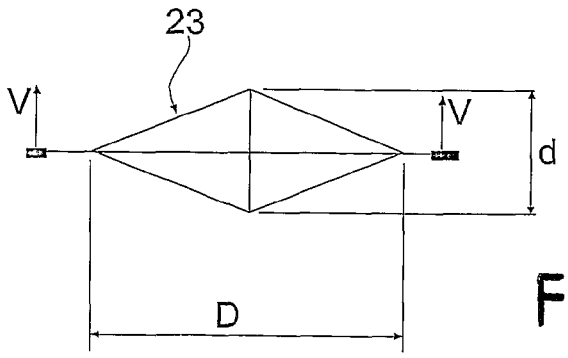
FIG. 4 is a plan view of a protuberance of one of the embossing rollers.
Figure 5:
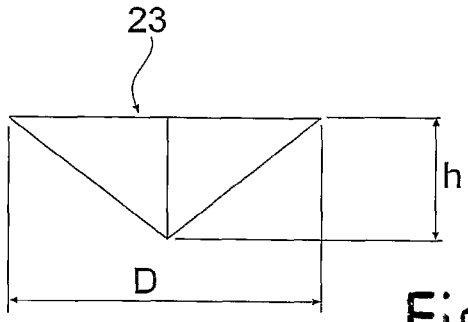
FIG. 5 is a side view of a protuberance of an embossing roller.

As illustrated in particular in FIGS. 4 and 5, the protuberances 23 can present a pyramidal shape with rhomboidal base, the minor diagonal of which is designated by d, and the major diagonal by D. The cavities 25 may present as incisions of a corresponding shape and enable penetration therein of the pyramidal protuberances. As may be noted in the drawing, the protuberances and the corresponding cavities 23, 25 are oriented in such a way that the major diagonal of the respective bases is parallel to the axes of rotation of the rollers 19, 21, i.e., oriented in a transverse direction with respect to the direction of advance of the layer S. The minor diagonal is oriented in the direction of advance of the layer S, referred to also as machine direction.

Set downstream of the embossing assembly 17 is a second drying drum or roller 27, entrained around which is the embossed layer S of papermaking fibers. The drum or roller 27 may be a Yankee roller, a Honeycomb roller, a TAD roller or any other equivalent system. For example, there can also be used drying systems comprising a plurality of rollers between which the wet-embossed layer S is entrained and dried inside a microwave oven or else by heating said rollers. At output from of the drying roller 27 (or equivalent drying system) the layer S by now dried, which forms a web of tissue paper ready for the subsequent conversion, is wound to form a reel B.

The drying process downstream of the embossing process stabilizes the deformation obtained in the embossing step so that the paper maintains stably in a resting condition the corrugation imparted on the paper by the protuberances 23 in combination with the cavities 25 of the embossing rollers 21 and 19. This bestows elasticity on the paper, which can be deformed like a spring also thanks to the particular form of embossing and, if subjected to tensile force, can undergo a lengthening that is useful in the subsequent transformation step, but will return to its original condition when the tensile stress ceases, at least for values of tensile stress that do not exceed the tearing load of the paper.

It is to be understood that part of the drying operation (or even the entire drying operation) can be obtained by heating one or the other or both of the embossing rollers 19 and 21 instead of by drying means set downstream of the embossing assembly.

Figure 6:
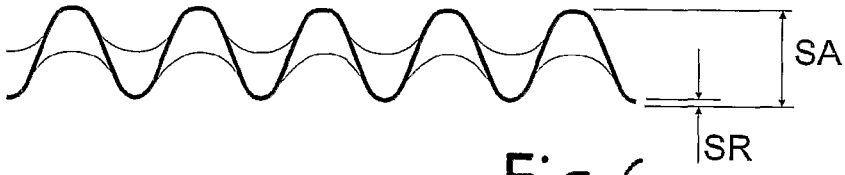
FIGS. 6 and 7 are enlarged schematic cross-sectional views of the paper obtained with the process according to the invention in a resting configuration and in a condition of elastic deformation that is assumed when the paper is subjected to a tensile force.
Figure 7:
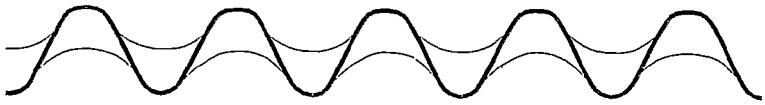

FIGS. 6 and 7 are schematic illustrations of a longitudinal section of the paper obtained with the system and method described herein. Said section has an alternation of protuberances and cavities corresponding to the distribution of the protuberances and cavities 23, 25 of the embossing rollers 19, 21. In this way, the apparent thickness SA of the paper is much greater than the actual thickness SR of the fiber layer that forms it.

The advantages of the above process or method of wet production of paper with respect to traditional methods are multiple. In the first place, it may be noted that the finished product, although it is a tissue paper that has all the characteristics of softness, absorption capability, and elasticity of a paper obtained by means of a system that envisages creping using a blade, is not obtained with the use of a creping blade. The consequence is elimination of all the drawbacks outlined previously, which characterize the use of the creping blade.

Since it is not necessary to use a creping blade co-operating with a Yankee cylinder for creping the paper, it is possible to add to the mixture of papermaking fibers a larger amount of softening agents, which have as side effect that of facilitating detachment from the Yankee cylinder without using a blade, enabling the production of softer papers with lower risks of tearing.

The above is possible also because, since the fibers are pressed together, there are created between them stronger bonds than with a traditional process, thus generating a web that requires a lower amount of fibers to obtain similar mechanical characteristics.

Since embossing is carried out between two rollers that are not pressed against one another, but rather are kept with the respective surfaces at a certain distance apart, the fibers are not compacted, and the paper maintains its characteristics of softness and absorbency.

In contrast with what occurs in the production of paper with the use of a Yankee roller and a creping blade, by using embossing rollers having surfaces characterized by protuberances and cavities, there is obtained a web without any "smooth" face. Hence, the paper does not require any particular attention in the step of transformation.

Using fine etching on the embossing rollers, i.e., cavities and protuberances 25, 23 of small dimensions, adopting the method according to the invention, there can be obtained surface characteristics of the paper which may be likened to those of the impressions left by the fabrics of TAD paper, but obtaining a much larger final thickness with a much lower energy consumption as compared to what may be achieved with the known systems. Finally, the process according to the invention enables a substantial increase in the productivity of continuous machines for the production of paper.

In fact, in traditional systems, the amount of pulp or aqueous suspension of papermaking fibers that the headbox can deposit on the forming fabric must take into account the fact that, in the creping step, the thickness of the paper is increased. Once the actual final thickness that it is desired to obtain after creping using the traditional method has been fixed, the thickness (and hence the amount of pulp) that the headbox can deposit on the forming fabric is in any case smaller than the one that the paper at output from the machine must possess. This involves a reduction in the amount of material per unit time that the headbox can supply and hence, in practice, a limitation of the overall productivity of the continuous machine. In other words, if the headbox can generate paper at a certain rate, for example 1000 m/min, this rate will be reduced to 800-900 m/min at the end of the process as a result of creping, which, by increasing the apparent thickness, reduces the dimension of the web corresponding to the direction of advance.

Instead, using the method according to the invention, in the embossing section, the paper (i.e., the partially dried layer of fibers) undergoes an increase in the actual thickness, accompanied by a lengthening in the direction of advance of the web. Consequently (and irrespective of further positive effects of embossing, which will be described hereinafter), the thickness of the layer S and hence the amount of material supplied by the headbox given the same final characteristics of the web on the reel, must be greater than the desired final thickness, since the effect of thickening caused by traditional creping is replaced by the thickening, which is even greater, and the lengthening generated by embossing. This means, basically, that the amount of aqueous suspension or mixture of papermaking fibers that can be supplied per unit time by the headbox is higher than what may be achieved in traditional continuous machines.

In other words, if the headbox can generate paper at a rate of 1000 m/min, this rate will rise to 1050-1100 m/min at the end of the process as a result of the lengthening impressed by embossing, which increases the dimension of the web corresponding to the direction of advance.

For example, supposing that we wish to reach an actual thickness SR of 0.08 mm of the paper at output (a value comparable to the most frequent data), using embossing rollers 19, 21 etched with protuberances and cavities of a pyramidal shape as illustrated in FIGS. 4 and 5 with dimensions $$D=0.8\text{ mm};\ d=0.291\text{ mm};\ h=0.174\text{ mm}$$

and on the hypothesis of achieving a deformation of the layer S of 80% of the height h of the protuberances, i.e., of, the depth of etching, we obtain the following apparent thickness:

$$SA=s+0.80*h=0.08+0.8*0.174=0.219\text{ mm}.$$

Furthermore, considering that the volume per unit surface of material of the embossed layer must be equal to the volume supplied by the headbox given the same unit surface (conservation of the volume) to obtain the actual final thickness of 0.08 mm, if it is taken into account that the initially plane layer is deformed following the lateral surface of the protuberances and cavities of the rollers 19, 21, given the dimensions indicated above of the incisions of the rollers, it is calculated that the thickness of the layer at output from the headbox must be 0.127 mm.

Said thickness is much greater than the one that could be obtained with a traditional continuous machine, given the same actual final thickness SR (0.08 mm). Assuming, with a conservative hypothesis, that to obtain an actual thickness SR at output from a machine with creping using a blade on a Yankee cylinder the thickness of the layer formed by the headbox will have to be 0.08 mm (and moreover neglecting the fact that in actual fact said thickness must be even smaller on account of the increase in actual thickness imposed by creping), the increase in productivity using the process according to the invention as compared to a system with creping blade is equal to a factor 0.127/0.08=1.587, which means an increase of approximately 60%.

The productivity of the continuous machine, in fact, is given by the volume of pulp that can be supplied in time given the same rate.

A further factor which in actual fact increases the productivity of the machine is represented by the fact that embossing increases the length of the layer or web of paper, so that the speed of the layer S at output from the embossing assembly 17 and consequently the speed of winding on the reel B is greater than the speed at input to the embosser 17 and, hence, greater than the rate at which the layer S is formed by the headbox. Instead, in traditional continuous machines, the winding rate is lower than the production rate on account of the reduction in length of the layer of paper caused by the creping blade.

A further important advantage of the invention lies in the fact that, given the final characteristics of the web obtained via embossing, it is possible to reduce the water content prior to final drying to lower levels than in traditional machines: this involves a lower requirement of energy to be used to complete total drying of the web. In addition, as has already been mentioned previously, the pressure previously exerted for squeezing out the water leads to the creation of hydrogen bonds, which are much more stable, and to a merging between the fibers, which increases the strength of the web obtained given the same substance, or else enables reduction in the substance albeit preserving good mechanical characteristics, with consequent saving in papermaking fibers.

Figure 8:
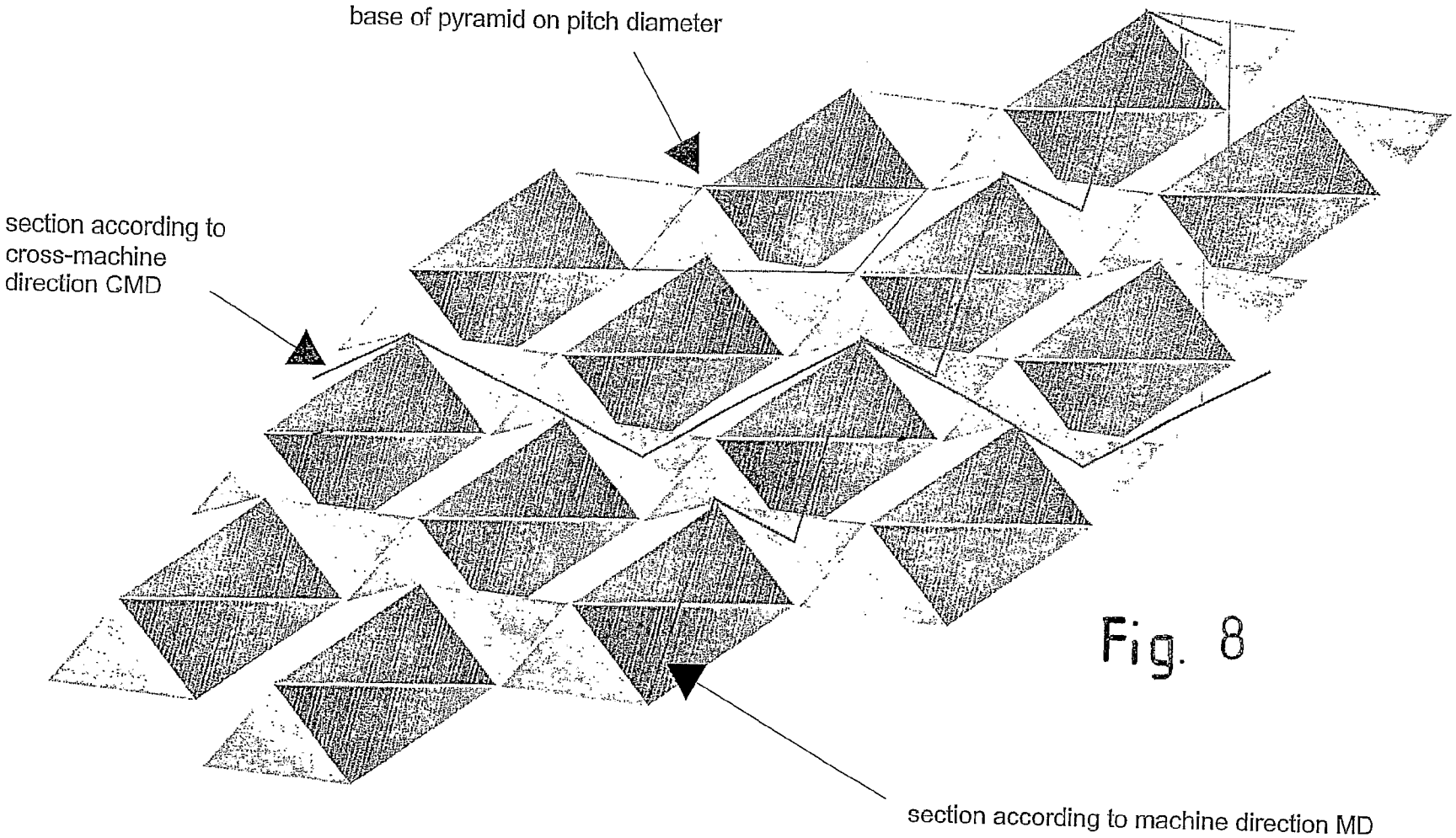
FIG. 8 is a schematic perspective view of a portion of paper obtained according to the invention.

FIG. 8 is a schematic perspective view of the embossed paper web. Indicated in the figure are the bases of the pyramidal protuberances with square base on the primitive diameter of the roller and the lines of section according to the machine direction (MD), i.e., the direction of advance, and according to the cross machine direction (CMD), which is orthogonal to the machine direction. It will be understood that the representation of FIG. 8 is purely schematic and that, in actual fact, the protuberances of the embossed web will be less faceted and may even present a round section, an elliptical section, or a section of some other shape.

Figure 9:
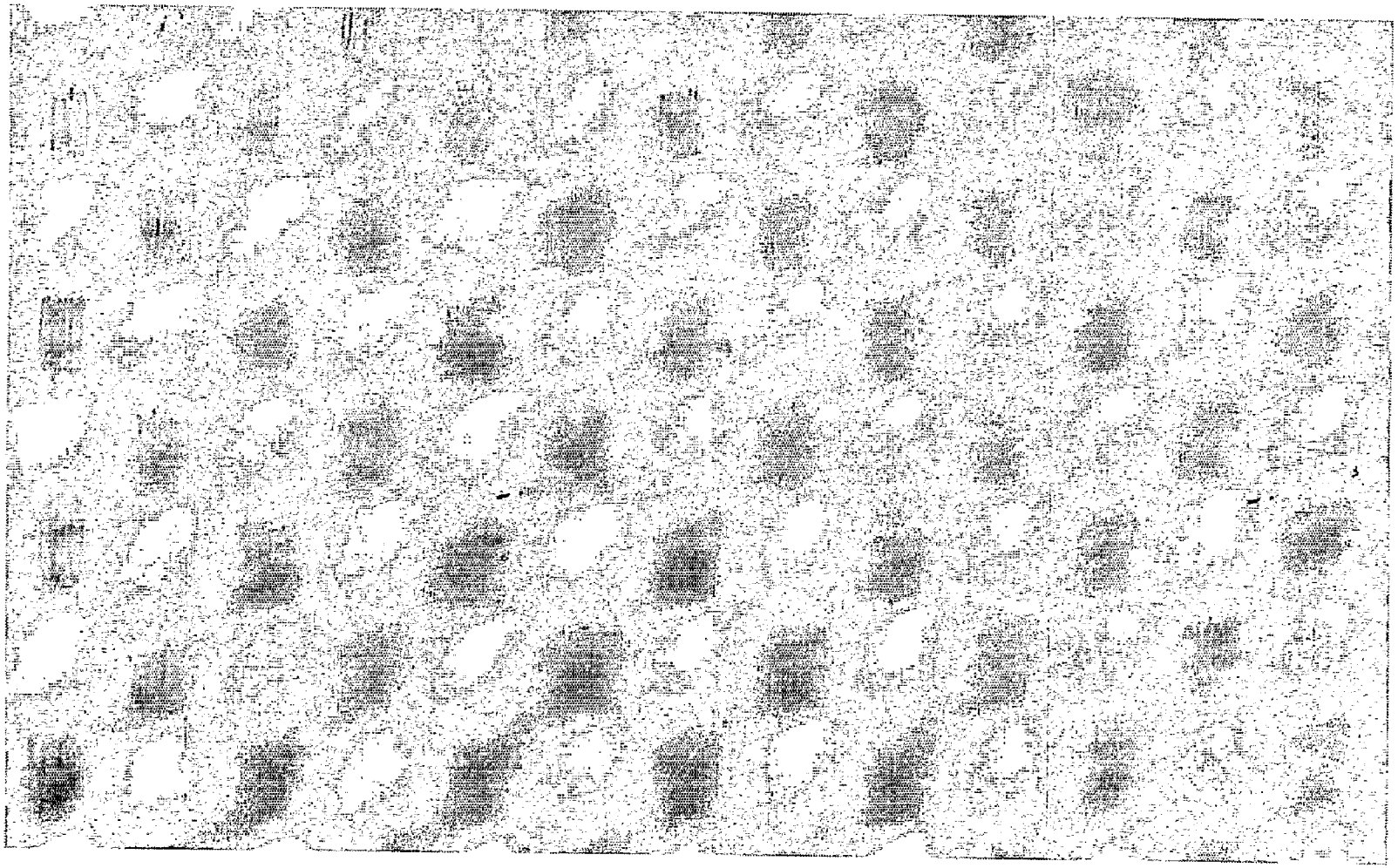
FIG. 9 shows an enlarged photograph of a portion of paper obtained with a process according to the invention but with protuberances of the embossing rollers having a profile shaped like a truncated pyramid or a pyramid with a base that is square, instead of rhomboidal.

FIG. 9 illustrates, by way of example, a macro-photograph of a portion of web produced according to the invention, with an embossing profile constituted by protuberances having the shape of a truncated pyramid with a base that is square instead of having an elongated rhomboidal base as illustrated in the foregoing figures.

Figure 1B:
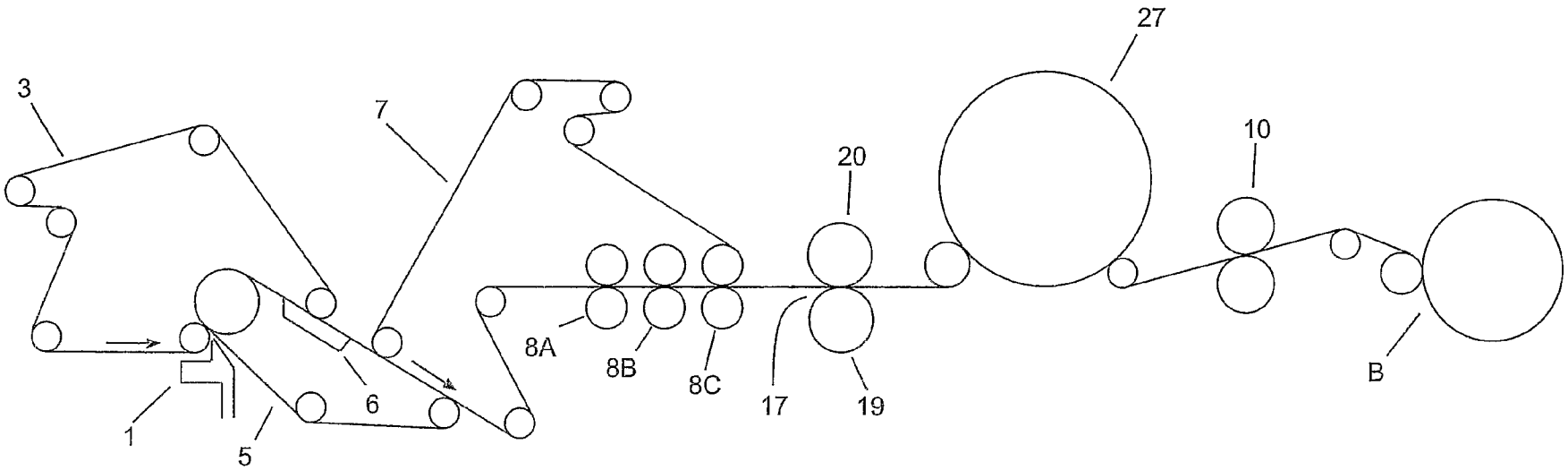
Figure 10:
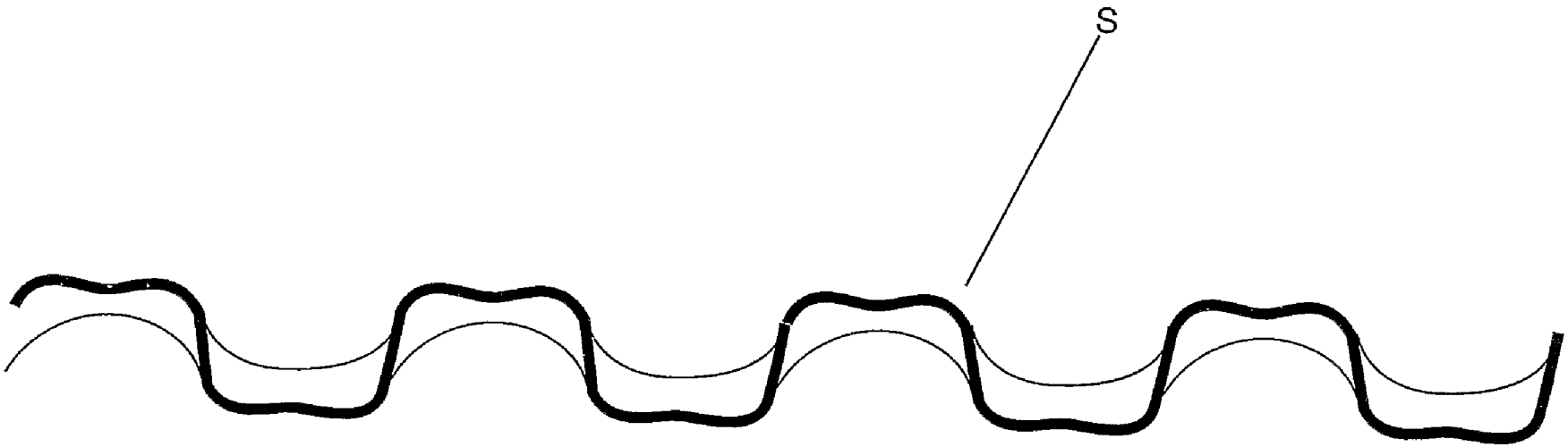
FIG. 10 shows a schematic enlargement of a section of paper obtained with a calendering step following upon embossing and, preferably, drying.

A modified embodiment of the system according to the invention is shown in FIG. 1B. Reference numbers that are the same designate parts that are the same or equivalent to those of FIG. 1A. The scheme of the system of FIG. 1B differs from that of FIG. 1A on account of the presence of a calender 10, which, in this example of embodiment, is set downstream of the drying drum 27. The calender 10 comprises two or more rollers pressed against one another or else kept at a limited distance from one another in order to calender the embossed layer S of tissue paper and flatten the protuberances that have been formed thereon by the embossing rollers 19, 20. FIG. 10 is a schematic cross section similar to that of FIG. 6. It may be noted that, on account of calendering, the paper has been brought down to a smaller thickness than that obtained after embossing, with flattening of the protuberances generated by the embossing rollers.

Calendering of the final web can be obtained even via pressure of just one cylinder, made of steel or coated with a resilient material, which co-operates directly with the Yankee drier or cylinder by flattening the web of paper before this is detached from the Yankee cylinder itself, in the case where the machine is made using this drying device.

Calendering bestows upon the surface of the paper a better feel. Calendering can be used also in combination with a different system for partial drying of the layer S prior to wet embossing, for example using a steel Yankee cylinder as drying drum, on which the layer S is dried partially and is then wet embossed.

Figure 1C:
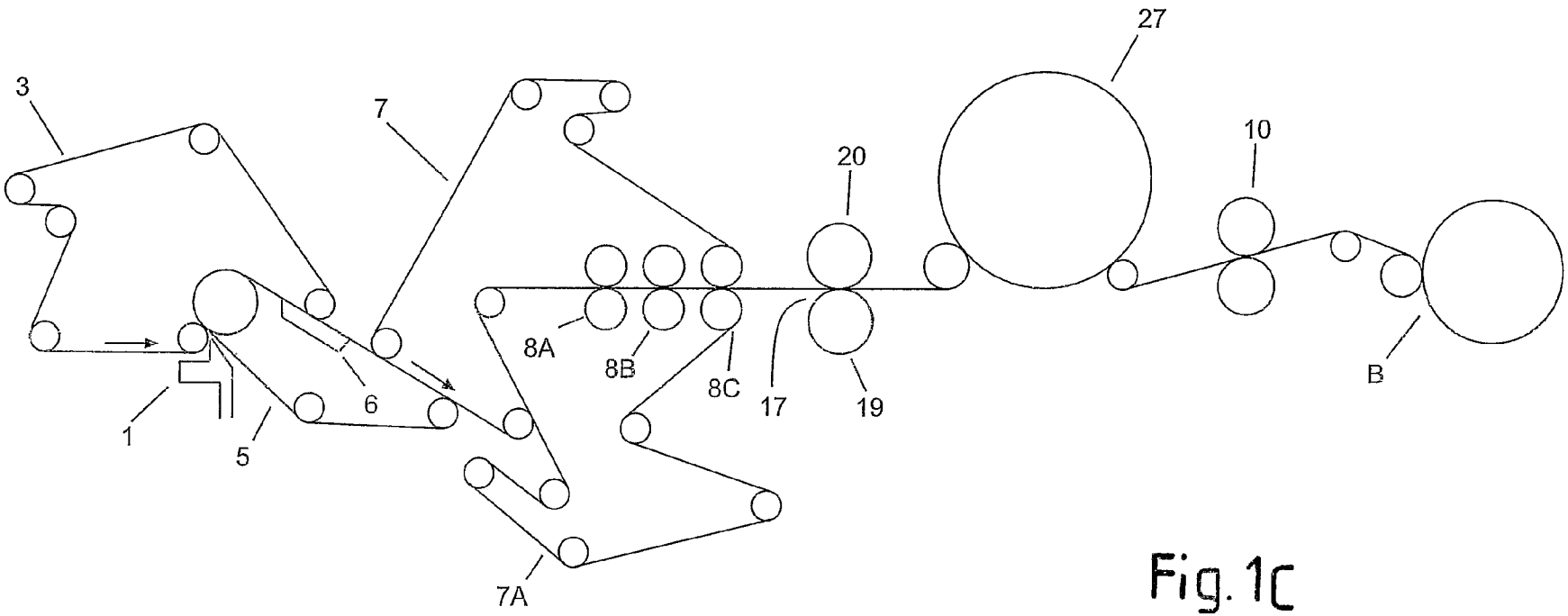

FIG. 1C shows a modified embodiment, in which the pressure for expelling part of the water content from the layer of aqueous mixture of papermaking fibers prior to embossing is obtained with the aid of two felts, designated by 7 and 7A, which pass through the nips defined by the pairs of pressure rollers 8A, 8B, 8C. The felts 7, 7A accompany the layer of fibers that is set between them through the squeezing nips. The felt 7A can extend as far as in the proximity of the embossing assembly 17. Alternatively two fabrics can be used, or else a felt and a fabric instead of two felts 7, 7A. The remaining parts of the system of FIG. 1C are the same as those of FIG. 1B.

In a modified embodiment the protuberances or projections and the cavities of the two embossing rollers can have a continuous linear shape, which extends parallel to the axis of the rollers or at an angle with respect thereto, possibly with a more or less marked corrugation. This provides an embossing in the form of corrugation or fluting, which is more closely similar to the creping traditionally obtained with a creping blade co-operating with a Yankee drier. The density of the longitudinal protuberances can be, for example, between 20 and 100 protuberances per cm.

It will be understood that the drawings shows just one possible embodiment of the invention, which may undergo variations as regards its shapes and arrangements, without thereby departing from the scope of the idea underlying the invention.

The invention claimed is:

1. A method for the production of a web of tissue paper, the method comprising the following steps in sequence:

depositing a layer of aqueous suspension of papermaking fibers on at least one forming fabric;

reducing the water content of said layer until the amount in weight of fibers in said layer is brought up to a first value;

after reduction of the water content, removing said layer from said formation fabric and feeding said layer to an embossing assembly including a pair of embossing rollers forming a nip therebetween, and wet-embossing said layer in said nip between said embossing rollers, wherein one of said embossing rollers is in contact with one surface of said layer and another one of said embossing rollers is in contact with another surface of said layer, said embossing rollers comprising protuberances and cavities, said protuberances of one of said embossing rollers penetrating into the cavities of another one of said embossing rollers;

drying said layer downstream of said nip to form a web of tissue paper, wherein said embossed layer is subject to calendering after wet-embossing.

2. A method according to claim 1, wherein the water content is reduced by pressing said layer with at least one pair of pressure rollers, which define a nip through which said layer is fed, until the amount in weight of fibers in said layer is brought up to said first value.

3. A method according to claim 2, wherein said embossed layer is entrained around a drying drum such that said embossed layer dries, said drying drum being a Yankee cylinder.

4. A method according to claim 1, wherein said embossed layer is entrained around a drying drum such that said embossed layer dries, said drying drum being a Yankee cylinder.

5. A method according to claim 1, wherein said embossed layer is entrained around a drying drum such that said embossed layer dries, said drying drum being a Yankee cylinder.

6. A method according to claim 1, wherein said first value of said amount in weight of fibers in said layer before wet embossing is between 20 wt % and 90 wt % with respect to the total weight of the layer.

7. A method according to claim 1, wherein the embossing rollers are provided with protuberances generated by etching, the cavities being defined by the empty spaces defined between adjacent protuberances.

8. A method according to claim 1, wherein said embossing rollers are provided with protuberances and cavities numbering between 20 and 120 per $cm^2$.

9. A method according to claim 8, wherein at least one of said embossing rollers provided with protuberances is decorated via the absence, even partial absence, of protuberances.

10. A method according to claim 1, wherein said layer is embossed with protuberances having a base with a first dimension and a second dimension, said first dimension being smaller than said second dimension.

11. A method according to claim 10, wherein said protuberances have a pyramidal shape with a quadrangular base.

12. A method according to claim 11, wherein said base is rhomboidal, with the minor diagonal oriented according to the direction of advance of the layer and the major diagonal oriented according to a transverse direction.

13. A method according to claim 1, wherein said protuberances have a shape with rounded edges.

14. A method according to claim 1, wherein said embossing rollers are metal rollers.

15. A method according to claim 1, wherein said first embossing roller is located at a spaced location from said second embossing roller such that the surfaces defining said protuberances and said cavities are not in mutual contact.

16. A method according to claim 15, wherein said two rollers are kept at a distance between centers such that the surface of the protuberances and the surface of the cavities are at a distance from one another by an amount equal to or greater than the thickness of the layer of papermaking fibers fed into said nip.

17. A method according to claim 1, wherein the water content of said layer is reduced prior to embossing to a value that will render said layer capable of withstanding the subsequent embossing process.

18. A method according to claim 17, wherein drying said embossed layer is obtained by means of a drying roller, said layer being detached from said drying roller without a creping blade.

19. A method according to claim 1, wherein said layer is dried to a final desired value downstream of the embossing rollers.

20. A method according to claim 1, wherein said layer is at least partially dried using said embossing rollers, at least one of said embossing rollers being heated.

21. A method according to claim 1, wherein hot-air hoods dry said layer.

22. A method according to claim 1, wherein said layer is not subjected to creping via a creping blade.

23. A method according to claim 1, wherein said layer is fed into a pressure roller nip formed by a pair of pressure rollers via at least one flexible member, said flexible member being a fabric or a felt, said flexible member extending through said pressure roller nip with said layer.

24. A method according to claim 1, wherein said layer is fed into a pressure roller nip formed by a pair of pressure rollers between two adjacent flexible members, said two adjacent flexible members being two fabrics or two felts or a fabric and a felt.

25. A method according to claim 1, wherein said layer is fed between said embossing rollers and embossed thereby without resting on a fabric or felt.

26. A method according to claim 1, wherein said first value of said amount in weight of fibers in said layer before wet embossing is between 40 wt % and 80 wt % with respect to the total weight of the layer.

27. A method according to claim 1, wherein said first value of said amount in weight of fibers in said layer before wet embossing is between 50 wt % and 70 wt % of fibers with respect to the total weight of the layer.

28. A method for the production of a web of tissue paper, the method comprising:

providing at least one formation fabric;

providing an aqueous suspension of papermaking fibers;

depositing a layer of said aqueous suspension of papermaking fibers on said at least one formation fabric;

removing moisture from said layer to form a partially dried layer;

removing said partially dried layer from said formation fabric after removing moisture from said layer;

providing a first embossing roller and a second embossing roller, said first embossing roller having a plurality of first projections and a plurality of first cavities, said plurality of first cavities being defined by said plurality of first projections, said second embossing roller having a plurality of second projections and a plurality of second cavities, said plurality of second cavities being defined by said plurality of second projections, said first embossing roller and said second embossing roller defining a nip, each of said first cavities receiving at least a portion of one of said second projections, each of said second cavities receiving at least a portion of one of said first projections;

passing said partially dried layer through said nip, wherein said partially dried layer is wet embossed by said first embossing roller and said second embossing roller to form an embossed partially dried layer, one side of said partially dried layer engaging one of said plurality of first projections and said plurality of said second projections to form a first wet embossed side of said partially dried layer, another side of said partially dried layer engaging another of said plurality first projections and said plurality of second projections to form a second wet embossed side of said partially dried layer; and drying said embossed partially dried layer after embossing said partially dried layer to form a substantially dried web of tissue paper.

29. A method according to claim 28, further comprising:

providing a calender;

subjecting said substantially dried web of tissue paper to said calender.

30. A method according to claim 29, wherein said embossed partially dried layer is dried with a drying roller, said calender comprising a first roller and a second roller, said calender being located downstream of said drying roller, said drying roller being located downstream of said first embossing roller and said second embossing roller.

31. A method according to claim 29, wherein said embossed partially dried layer is entrained around a drying drum such that said embossed partially dried layer is substantially dry, said drying drum being a Yankee cylinder.

32. A method according to claim 28, further comprising:

providing at least one pair of pressure rollers, said at least one pair of pressure rollers defining a pressure roller nip, wherein the moisture is reduced by pressing said layer with said at least one pair of pressure rollers, said layer being fed through said pressure roller nip until an amount in weight of fibers in said layer reaches a predetermined moisture content level.

33. A method according to claim 32, wherein said embossed partially dried layer is entrained around a drying drum such that said embossed partially dried layer is substantially dry, said drying drum being a Yankee cylinder.

34. A method according to claim 28, wherein said embossed partially dried layer is entrained around a drying drum such that said embossed partially dried layer is substantially dry, said drying drum being a Yankee cylinder.

35. A method according to claim 28, wherein an amount in weight of fibers in said layer before wet embossing is between 20 wt % and 90 wt % with respect to a total weight of the layer.

36. A method according to claim 28, wherein said plurality of first projections and said plurality of second projections are generated by etching.

37. A method according to claim 28, wherein said plurality of first projections and said plurality of first cavities number between 20 and 120 per $cm^2$, said plurality of second projections and said plurality of second cavities numbering between 20 and 120 per $cm^2$.

38. A method according to claim 37, wherein at least one of said first embossing roller and said second embossing roller is at least partially devoid of at least one of said plurality of first projections and said plurality of second projections.

39. A method according to claim 28, wherein said plurality of first projections and said plurality of second projections have a base with a first dimension and a second dimension, said first dimension being smaller than said second dimension.

40. A method according to claim 28, wherein said plurality of first projections and said plurality of second projections have a pyramidal shape with a quadrangular base.

41. A method according to claim 40, wherein said base is rhomboidal, with a minor diagonal oriented according to a direction of advance of the layer and a major diagonal oriented according to a transverse direction of advance of the layer.

42. A method according to claim 28, wherein said plurality of first projections and said plurality of second projections have a shape with rounded edges.

43. A method according to claim 28, wherein said first embossing roller and said second embossing roller are metal rollers.

44. A method according to claim 28, wherein said first embossing roller is located at a spaced location from said second embossing roller such that a surface defining said plurality of first projections and said plurality of first cavities and a surface defining said plurality of second projections and said plurality of second cavities are not in mutual contact.

45. A method according to claim 28, wherein said first embossing roller is located at a spaced location from said second embossing roller such that a distance between said first embossing roller and said second embossing roller is equal to or greater than a thickness of the layer of papermaking fibers fed into said nip.

46. A method according to claim 28, wherein the moisture of said layer is reduced prior to embossing to a value that will render said layer capable of withstanding the subsequent embossing process.

47. A method according to claim 46, wherein drying said embossed partially dried layer is obtained by means of a drying roller, said layer being detached from said drying roller without a creping blade.

48. A method according to claim 28, wherein said layer is dried to a final desired value downstream of said first embossing roller and said second embossing roller.

49. A method according to claim 28, wherein said partially dried layer is at least partially dried via at least one of said first embossing roller and said second embossing roller, at least one of said first embossing roller and said second embossing roller being heated.

50. A method according to claim 28, wherein hot-air hoods dry said layer.

51. A method according to claim 28, wherein said layer is not subjected to creping via a creping blade.

52. A method according to claim 28, further comprising:

providing at least one pair of rollers defining a pressure roller nip;

providing at least one flexible member, wherein said layer is fed into said pressure roller nip via said at least one flexible member, said flexible member being a fabric or a felt, said flexible member extending through said pressure roller nip with said layer.

53. A method according to claim 28, further comprising:

providing at least one pair of rollers defining a pressure roller nip;

providing two adjacent flexible members, wherein said layer is fed into said pressure roller nip between said two adjacent flexible members, said two adjacent flexible members being two fabrics or two felts or a fabric and a felt.

54. A method according to claim 28, wherein said layer is fed between said first embossing roller and said second embossing roller and said layer is embossed via said first embossing roller and said second embossing roller without resting on a fabric or felt.

55. A method for the production of a web of tissue paper, the method comprising:

providing at least one formation fabric;

providing an aqueous suspension of papermaking fibers;

depositing a layer of said aqueous suspension of papermaking fibers on said at least one formation fabric, said layer having a layer moisture content;

providing at least a first pressure roller and at least a second pressure roller, said first pressure roller being opposite said second pressure roller, said first pressure roller and said second pressure roller defining a pressure roller nip;

passing said layer through said pressure roller nip to form a partially dried layer, said partially dried layer having a partially dried layer moisture content, said partially dried layer moisture content being less than said layer moisture content;

removing said partially dried layer from said formation fabric after passing said layer through said pressure roller nip;

providing a first embossing roller and a second embossing roller, said first embossing roller having a plurality of first projections and a plurality of first cavities, said plurality of first cavities being defined by said plurality of first projections, said second embossing roller having a plurality of second projections and a plurality of second cavities, said plurality of second cavities being defined by said plurality of second projections, said first embossing roller and said second embossing roller defining an embossing roller nip, each of said first cavities receiving at least a portion of one of said second projections, each of said second cavities receiving at least a portion of one of said first projections;

passing said partially dried layer through said embossing roller nip, wherein said partially dried layer is wet embossed by said first embossing roller and said second embossing roller to form a wet embossed partially dried layer, one side of said partially dried layer engaging one of said plurality of first projections and said plurality of said second projections to form a first wet embossed side of said partially dried layer, another side of said partially dried layer engaging another of said plurality first projections and said plurality of second projections to form a second wet embossed side of said partially dried layer;

providing a drying roller; and drying said embossed partially dried layer with said drying roller after wet embossing said partially dried layer to form a substantially dried web of tissue paper, said substantially dried web of tissue paper having a tissue paper moisture content, said tissue paper moisture content being less than said partially dried layer moisture content.

56. A method according to claim 55, wherein said first pressure roller, said second pressure roller, said first embossing roller and said second embossing roller are located at a position upstream of said drying roller with respect a traveling direction of said layer, said drying roller being arranged downstream of said first embossing roller and said second embossing roller.

57. A method according to claim 56, further comprising:

providing a calender, said calender comprising a first roller and a second roller, said first roller and said second roller defining a calender roller nip; and passing said substantially dried web of tissue paper through said calender roller nip, said first roller and said second roller are located downstream of said drying roller.

* * * * *